United States Patent [19]

Kojima et al.

[11] Patent Number: 4,917,995

[45] Date of Patent: Apr. 17, 1990

[54] SILVER HALIDE PHOTOGRAPHIC MATERIAL

[75] Inventors: Tetsuro Kojima; Tetsunori Matsushita; Ichizo Toya; Kazuhiko Takeuchi, all of Kanagawa, Japan

[73] Assignee: Fuji Photo Film Co., Ltd., Kanagawa, Japan

[21] Appl. No.: 212,746

[22] Filed: Jun. 28, 1988

[30] Foreign Application Priority Data

Jun. 30, 1987 [JP] Japan ..... 62-163622

[51] Int. Cl.[4] ..... G03C 1/02; G03C 1/08

[52] U.S. Cl. ..... 430/565; 430/955; 430/965; 430/933

[58] Field of Search ..... 430/565, 955, 965, 933

[56] References Cited

U.S. PATENT DOCUMENTS 4,526,853 7/1985 Nishijima et al. ..... 430/933

4,659,651 4/1987 Tagihara et al. ..... 430/955

*Primary Examiner*—Paul R. Michl

*Assistant Examiner*—Thorl Chea

*Attorney, Agent, or Firm*—Sughrue, Mion, Zinn, Macpeak & Seas

[57] ABSTRACT

A silver halide photographic material for obtaining silver images is described, comprising at least one silver halide emulsion layer on a support having a white reflection layer, wherein at least one compound represented by formula (I) is contained in at least one of the constituent layers:

(I)

wherein $X^1$ represents a divalent bonding group bonded by way of a hetero atom to a carbon atom; A represents a group capable of controlling the tone of silver images, which is bonded to $X^1$ by way of the hetero atom of A; $R^1$, $R^2$ and $R^3$ each represents a hydrogen atom or a group that can be substituted, in which $R^1$ and $R^2$, or $R^1$ and $R^3$ may further be bonded together to form a carbocyclic ring or a heterocyclic ring; Y represents:

a cyano group or a nitro group, in which $R^4$, $R^5$, $R^6$, $R^7$ $R^8$ may each represent a hydrogen atom or a group that can be substituted; n and m represent 0 or 1, provided that if m is 0, the group represented by A is bonded to a carbon atom by way of the hetero atom of A.

7 Claims, No Drawings

SILVER HALIDE PHOTOGRAPHIC MATERIAL

FIELD OF THE INVENTION

The present invention concerns silver halide black and white photographic materials having a white reflection support for observing silver images and, particularly, it relates to silver halide photographic materials having an excellent tone.

BACKGROUND OF THE INVENTION

For controlling the tone of silver images, there are known compounds containing sulfur atoms, which are easily adsorbed to silver (for example, mercapto compounds and thiazoline-thione compounds). However, since these compounds are easily adsorbed to silver halides, there are problems in that adsorption of sensitizing dyes are inhibited, sensitivity is reduced and remarkable blackening of images due to auxiliary exposure can not be prevented. The image blackening due to anxiliary exposure (i.e., post exposure) occurs in the situation where the photosensitive material is left in a dark room for a long period of time before development after imagewise exposure. In this case, the entire light-sensitive material is developed and finished blackishly by the exposure to safe-light in a dark room which reduces the image contrast and degrades the overall appearance.

If the above-mentioned phenomenon should occur, the value as the photographic material is remarkably degraded.

It has been surprisingly found that the remarkable blackening phenomenon to images due to auxiliary exposure can be prevented by the use of the compound according to the present invention.

SUMMARY OF THE INVENTION

A first object of the present invention is to provide a silver halide photographic material for obtaining silver images containing a compound capable of changing the tone of silver images (particularly to a warm tone) without lowering the sensitivity of the photographic material.

A second object of the present invention is to provide a silver halide photographic material for obtaining silver images containing a compound capable of preventing the blackening of the images due to auxiliary exposure.

The foregoing objects of the present invention can be attained by a silver halide photographic material for obtaining silver images comprising at least one silver halide emulsion layer on a support having a white reflection layer, wherein at least one compound represented by formula (I) is contained in at least one of the constituent layers:

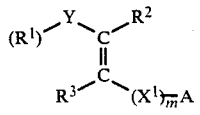

(I)

wherein $X^1$ represents a divalent bonding group bonded to the carbon atom by way of a hetero atom; A represents a group capable of controlling the tone of silver images, which is bonded to X' by way of the hetero atom of A; $R^1$, $R^2$ and $R^3$ each represents a hydrogen atom or a group that can be substituted in which $R^1$ and $R^2$, or $R^1$ and $R^3$ may further be bonded together to form a carbocyclic ring or a heterocyclic ring; Y represents

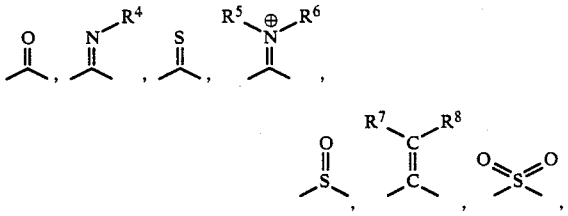

a cyano group or a nitro group (in which $R^4$, $R^5$, $R^6$, $R^7$ and $R^8$ may each represent a hydrogen atom or a group that can substituted); n and m represent 0 or 1, provided that if m is 0, the group represented by A is bonded to a carbon atom by way of the hetero atom of A.

DETAILED DESCRIPTION OF THE INVENTION

Formula (I) is described in detail below.

$R^1$ in formula (I) represents a hydrogen atom or a group that can be substituted. Examples of the group that can be substituted include an alkyl group (preferably with 1 to 20 carbon atoms), an alkenyl group (preferably with 2 to 20 carbon atoms), an aryl group (preferably with 6 to 20 carbon atoms), an alkoxy group (preferably with 1 to 20 carbon atoms), an aryloxy group (preferably with 6 to 20 carbon atoms), an alkylthio group (preferably with 1 to 20 carbon atoms), an arylthio group (preferably with 6 to 20 carbon atoms), an amino group, such as non-substituted amino group, or a secondary or tertiary amino group (preferably substituted with an alkyl group of 1 to 20 carbon atoms, an aryl group of 6 to 20 carbon atoms, or a hydroxy group). Among these, the preferred $R^1$ in formula (I) represents an alkyl group, an aryl group or an alkoxy group.

Furthermore, $R^1$ may be bonded $R^2$ or $R^3$ to form a carbocyclic ring or heterocyclic ring, for example, a 5 to 7 membered ring.

$R^2$ and $R^3$, which may be same or different to each other, each may represent a hydrogen atom or a group that can be substituted. Examples of the group that can be substituted include a halogen atom (such as fluorine, chlorine and bromine), an alkyl group (preferably with 1 to 20 carbon atoms), an aryl group (preferably with 6 to 20 carbon atoms), an alkoxy group (preferably with 1 to 20 carbon atoms), an aryloxy group (preferably with 6 to 20 carbon atoms), an alkylthio group (preferably with 1 to 20 carbon atoms), an arylthio group (preferably with 6 to 20 carbon atoms), an acyloxy group (preferably with 2 to 20 carbon atoms), an amino group, such as a non-substituted amino group, or a secondary or tertiary amino group (preferably substituted with an alkyl group with 1 to 20 carbon atoms or an aryl group with 6 to 20 carbon atoms), a carbonamide group (preferably an alkyl carbonamide group with 1 to 20 carbon atoms and an aryl carbonamide group with 6 to 20 carbon atoms), an ureido group (preferably an alkylureido group with 1 to 20 carbon atoms or an arylureido group with 6 to 20 carbon atoms), a carboxy group, a carbonate ester group (preferably an alkylcarbonate ester group with 1 to 20 carbon atoms or an arylcarbonate ester group with 6 to 20 carbon atoms), an oxycarbonyl group (preferably an alkyloxycarbonyl group with 1 to 20 carbon atoms or a aryloxycarbonyl group with 6 to 20 carbon atoms), a carbamoyl group (preferably an alkylcarbamoyl group with 1 to 20 carbon atoms or an arylcarbamoyl group with 6 to 20 carbon atoms), an acyl group (preferably an alkyl carbonyl group with 1 to 20 carbon atoms or an arylcarbonyl group with 6 to 20 carbon atoms), a sulfo group, a sulfonyl group (preferably an alkylsulfonyl group with 1 to 20 carbon atoms or an arylsulfonyl group with 6 to 20 carbon atoms), a sulfinyl group (preferably an alkylsulfinyl group with 1 to 20 carbon atoms or an arylsulfinyl group with 6 to 20 carbon atoms), a sulfamoyl group (preferably an alkylsulfamoyl group with 1 to 20 carbon atoms or an arylsulfamoyl group with 6 to 20 carbon atoms), a cyano group or a nitro group. Among these, the preferred $R^2$ and $R^3$ in formula (I) represent a hydrogen atom, a halogen atom, an alkyl group, an alkylthio group, an arylthio group, a sulfonyl group, a sulfinyl group, a cyano group or a nitro group. Y in formula (I) represents

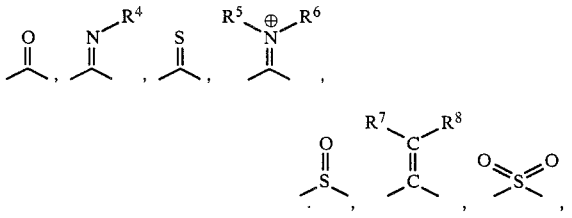

A cyano group or a nitro group, in which $R^4$, $R^5$, $R^6$, $R^7$ and $R^8$ (which may be same or different) may each represent a hydrogen atom or a group that can be substituted. Specific examples of the group that can be substituted include an alkyl group (preferably with 1 to 20 carbon atoms), an alkenyl group (preferably with 2 to 20 carbon atoms), an aryl group (preferably with 6 to 20 carbon atoms), an alkoxy group (preferably with 1 to 20 carbon atoms), an aryloxy group (preferably with 6 to 20 carbon atoms), an acyloxy group (preferably with 2 to 20 carbon atoms), an amino group, such as a non-substituted amino group, or preferably, a secondary or tertiary amino group (substituted with a alkyl group with 1 to 20 carbon atoms or an aryl group with 6 to 20 carbon atoms), a carbonamide group (preferably an alkyl carbonamide group with 1 to 20 carbon atoms or an arylcarbonamide group 6 to 20 carbon atoms), a ureido group (preferably an alkylureido group with 1 to 20 carbon atoms or an arylureido group with 6 to 20 carbon atoms), an oxycarbonyl group (preferably alkyloxy carbonyl group with 1 to 20 carbon atoms or aryloxycarbonyl group with 6 to 20 carbon atoms), a carbamoyl group (preferably an alkylcarbamoyl group with 1 to 20 carbon atoms or an arylcarbamoyl group with 1 to 20 carbon atoms), an acyl group (preferably a alkylcarbonyl group with 1 to 20 carbon atoms or an arylcarbonyl group with 6 to 20 carbon atoms), a sulfonyl group (preferably a alkylcarbonyl group with 1 to 20 carbon atoms or an arylcarbonyl group with 6 to 20 carbon atoms), a sulfonyl group (preferably an alkylsulfonyl group with 1 to 20 carbon atoms or an arylsulfonyl group with 6 to 20 carbon atoms), a sulfinyl group (preferably an alkylsulfinyl group with 1 to 20 carbon atoms or an arylsulfinyl group with 6 to 20 carbon atoms), a sulfamoyl group (preferably an alkylsulfamoyl group with 1 to 20 carbon atoms or an arylsulfamoyl group with 6 to 20 carbon atoms). Among these groups, preferred groups represented by $R^7$ and $R^8$ include an oxycarbonyl group, a carbamoyl group, an acyl group, a sulfonyl group, a sulfamoyl group, a sulfinyl group, a cyano group and a nitro group. These groups may be further substituted. Where there are two or more substituents, these substituents may be same or different with respect to each other. Specific substituents may include the groups that can be substituted as described above for $R^1$. A carbocyclic ring or heterocyclic ring formed from $R^1$ and $R^3$ or $R^1$ and $R^2$ preferably include those represented by formulae (II) or (III).

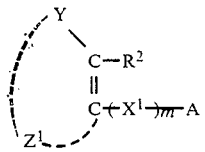

(II)

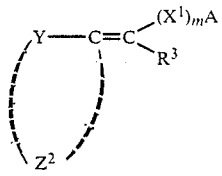

(III)

In formula (II), $Z^1$ represents a group of atoms necessary for forming a carbocyclic ring or heterocyclic ring.

Specifically, they are, for example, 5-membered, 6-membered or 7-membered carbocyclic ring or 5-membered, 6-membered or 7-membered heterocyclic ring containing one or more of nitrogen, oxygen or sulfur atoms. Those carbocycilc rings or heterocyclic rings which form a condensed ring at an appropriate position may also be included.

Specifically, they can include, cyclopentenone, cyclohexenone, cycloheptenone, benzocycloheptenone, benzocyclopentenone, benzocyclohexenone, 4-pyridone, 4-quinolone, 2-pyrone, 4-pyrone, 1-thio-2-pyrone, 1-thio-4-pyrone, coumarin, chromone, uracyl, as well as the following:

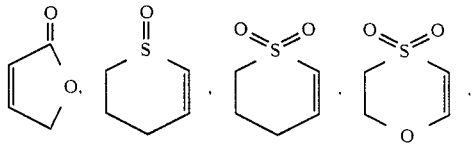

-continued

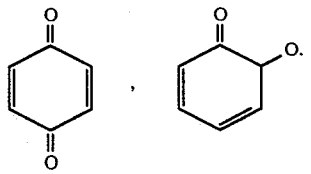

These carbocyclinc rings or heterocyclic rings may have one or more substituents, and if there are two or more substituents, they may be same or different with respect to each other. Specific substituents can include, the same groups as the groups that can be substituted as described above for $R^1$.

Further, $Z^2$ in formula (III) is identical to $Z^1$ in formula (II). $Z^2$ may specifically represent cyclopentanone, cyclohexanone, cycloheptanone, benzocycloheptanone, benzocyclopentanone, benzocyclohexanone, 4-tetrahydropyridone, 4-dihydroquinolone and 4-tetrahydropyrone. These carbocyclic rings or heterocyclic rings may have one or more substituents, and if there are two or more substituents, they may be same or different with respect to each other. As specific substituents for these carbocyclic or heterocyclic rings, identical substituents as the groups that can be substituted as described above for $R^1$ may be employed.

$R^2$, $R^3$, $X^1$, A, and m are the same as defined above in formula (I).

A in formulae (I), (II) and (III) may be bonded directly by way of the hetero atom of A (for example, a sulfur atom, nitrogen atom, oxygen atom, etc.), if m is 0, or A may be bonded by way of $X^1$, if m is 1.

$X^1$ in formulae (I), (II) and (III) represent a divalent bonding group which is bonded by way of the hetero atom (for example, sulfur atom, nitrogen atom, or oxygen atom) in the bonding group, and further represents those groups which are split as $X^1$-A upon treatment (more specificaly, under a pH condition of 9 to 12) and which then rapidly release A.

Such bonding groups can include those releasing A by an intra-molecular ring closing reaction, as described in Japanese Patent Application (OPI) No. 145,135/79 (corresponding to British Patent Laid-Open No. 2,010,818A), U.S. Pat. Nos. 4,248,962 and 4,409,323 and British Pat. No. 2,096,783; those releasing A by intra-molecular electron transfer as described in British Pat. No. 2,072,363, Japanese Patent Application No. (OPI) 154,234/82; those releasing A while releasing gaseous carbon dioxide, as described in Japanese Patent Application (OPI) No. 179,842/82; or those releasing A while releasing formalin, as described in Japanese Patent Application (OPI) No. 93,422/84. The term "OPI" as used herein means a "published unexamined Japanese patent application". Typical examples of $X^1$ as described above, are shown below, together with the structural formula A.

(1)

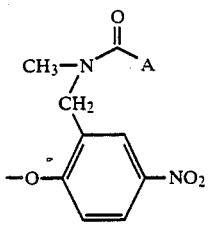

(2)

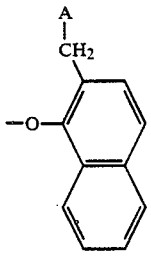

(3)

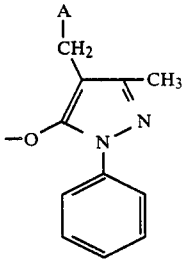

(4)

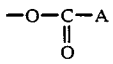

(5)

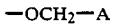

(6)

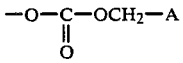

(7)

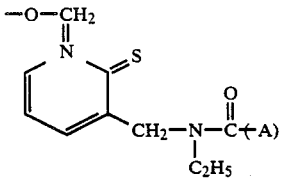

(8)

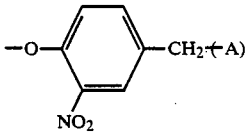

(9)

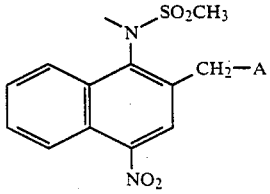

-continued (10)

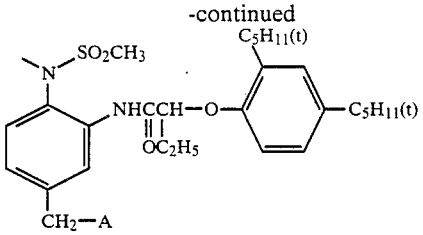

(11)

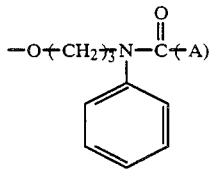

(12)

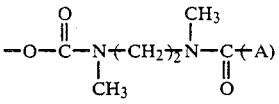

(13)

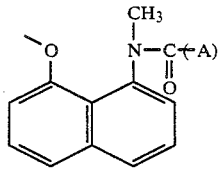

$X^1$ is selected depending on the required timing for releasing A, control for the releasing and the kind of A used, etc.

Examples of the compound for controlling the tone of silver images represented by A in formulae (I), (II) and (III) can include those compounds having a mercapto group bonded to a heterocyclic group, for example, substituted or unsubstituted mercapto azoles (specifically, 1-phenyl-5-mercaptotetrazole, 1-(4-carboxyphenyl)-5-mercaptotetrazole, 1-(4-sulfophenyl)-5-mercaptotetrazole, 1-(4-sulfamoylpyenyl)-5-mercaptotetrazole, 2-methyl-thio-5-mercapto-1,3,4-thiadiazole, 2-phenyl-5-mercapto-1,2,4-triazole, 2-(2-dimethylaminoethylthio)-5-mercapto-1,3,4-thiadiazole, 2-mercaptobenzooxazole, 2-mercaptobenzoimidazole, 2-mercapgobenzothiazole, 2-phenyl-5-mercapto-1,3,4-oxadiazole, 1-(3-(3-methylureido)phenyl)-5-mercaptotetrazole, etc.); substituted or unsubstituted mercaptoazaindenes (specifically, 6-methyl-4-mercapto-1,3,3a,7-tetrazaindene, 6-phenyl-4-mercaptotetrazaindene, 4,6-dimethyl-2-mercapto-1,3,3a,7-tetrazaindene, etc.); substituted or unsubstituted mercaptopyrimidines (specifically, 2-mercaptopyrimidine, 2-mercapto-4-methyl-6-hydroxyprimidine, etc.); and heterocyclic compounds capable of forming imino silver such as substituted or unsubstituted benzotriazoles (specifically, benzotriazole, 5-nitrobenzotriazole, 5-methylbenzotriazole etc.); substituted or unsubstituted indazoles (specifically, indazole, 5-nitroindazole, 3-nitroindazole, etc.); substituted or unsubstituted benzoimidazoles (specifically, 5-nitrobenzoimidazole and 4-nitrobenzoimidazole).

Furthermore, A forms a compound having an effect of controlling the tone of silver images after releasing from the mother nuclei of formulae (I), (II) and (III) in the developing step. The compound may subsequently be converted further into a compound having either no effect or a remarkably reduced effect with regard to controlling the tone.

Specifically, they can include, 1-(3-phenoxycarbonylphenyl)-5-mercaptotetrazole,
1-(4-phenoxycarbonylphenyl)-5-mercaptotetrazole,
1-(3-maleinimidephenyl)-5-mercaptotetrazole,
5-(phenoxycarbonyl)benzotriazole,
2-phenoxycarbonylmethylthio-5-mercapto-1,3,4-thiadiazole, etc.

The compound represented by A preferably includes those compounds having mercapto groups bonded to the hetero ring.

The compound represented by A more preferably includes those compounds represented by formulae (IV) or (V)

(IV)

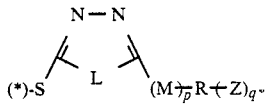

wherein L represents an oxygen atom, a sulfur atom or a selenium atom.

M represents

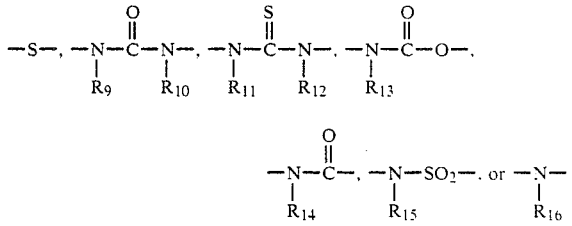

$R_9$, $R_{10}$, $R_{11}$, $R_{12}$, $R_{13}$, $R_{14}$, $R_{15}$ and $R_{16}$ may represent a hydrogen atom, a substituted or unsubstituted alkyl group having generally 1 to 6 carbon atoms (for example, a methyl group, an ethyl group, a propyl group, a 2-dimethylaminoethyl group, etc.), a substituted or unsubstituted aryl group having generally 6 to 12 carbon atoms (for example, a phenyl group, a 2-methylphenyl group etc.), a substituted or unsubstituted alkenyl group having generally 2 to 6 carbon atoms (for example, a propenyl group, a 1-methylvinyl group, etc.), or a substituted or unsubstituted aralkyl group having generally 7 to 12 carbon atoms (for example, a benzyl group, phenethyl group, etc.).

R represents a hydrogen atom; a substituted or branched alkylene group (for example, a methylene group, an ethylene group, a propylene group, a butylene group, a hexylene group, a 1-methylethyl group, etc.); straight or branched alkenylene group (for example, a vinylene group, a 1-methylvinylene group, etc.); straight or branched aralkylene group (for example, a benzylidene group, etc.); an arylene group (for example, a phenylene group, a naphthylene group, etc.). Among these, the preferred R represents a hydrogen atom or a substituted or branched alkylene group. The group represented by R may be further substituted. The substituents which are further substituted to R represent the group that can be substituted as described above for $R^1$.

Z represents a hydrogen atom, a hydroxyl group; a cyano group, a substituted or unsubstituted amino group, including a salt form thereof, (for example, an amino group, a hydrochloride of amino group, a methylamino group, a dimethylamino group, a hydrochloride of dimethylamino group, a dibutyl amino group, a dipropylamino group, a N-dimethylamino-N-methylamino group, etc.); a quaternary ammonium group (for example, a trimethyl ammonium group, a dimethylbenzyl ammonium group, etc.); an alkoxy group (for example, a methoxy group, an ethoxy group, a 2-methoxyethoxy group, etc.); a sulfonyl group (for example, a methanesulfonyl group, an ethanesulfonyl group, a p-toluenesulfonyl group, etc.); a carbamoyl group (for example, an unsubstituted carbamoyl group, a methyl carbamoyl group, etc.); a sulfamoyl group (for example, an unsubstituted sulfamoyl group, a methylsulfamoyl group, etc.); a carbonamide group (for example, an acetoamide group, a benzoamide group, etc.); a sulfonamide group (for example, a methanesulfonamide group, a benzenesulfonamide group, etc.); a acyloxy group (for example, a acetyloxy group, a benzoyloxy group, etc.); a ureido group (for example, an unsubstituted ureido group, a methylureido group, an ethylureido group, etc.); an acyl group (for example, an acetyl group, a benzoyl group, etc.); a heterocyclic group (for example, a 1-morpholino group, a 1-piperidino group, a 2-pyridyl group, a 4-pyridyl group, a 2-thienyl group, a 1-pyrazolyl group, a 1-imidazolyl group, a 2-hydrofuryl group, a 2-tetrahydrothienyl group, etc.); an oxycarbonyl group (for example, a methoxycarbonyl group, a methylthiomethoxycarbonyl group, a phenoxycarbonyl group, etc.); or a carbonic acid and salt thereof or a sulfonic acid and salt thereof. Among these, the preferred Z represents a hydrogen atom, a hydroxyl group, an amino group, a quaternary ammonium group, an alkoxy group, a ureido group, a heterocyclic group, a carbonic acid, or a sulfonic acid.

p represents 0 or 1.

q represents 0 if R is a hydrogen atom, and represents 1 if R is not a hydrogen atom.

(*) represents the position bonded to $(X^1)m$ in formulae (I)–(III).

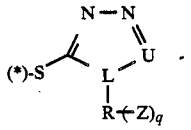

(V)

wherein, R, Z, q and (*) have the same meanings as described above for formula (IV).

T and U represent

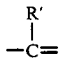

or —N=, and R′ represents a halogen atom (for example, a chlorine atom, a bromine atom, etc.); a nitro group; or $\text{-}(M)_pR\text{-}(Z)_q$.

M, R, Z, p and q have the same meaning as described for formula (IV), in which the portion $\text{-}(R\text{—}/z)_q$ in R′ may be same or different form $\text{—}R\text{-}(Z)_q$ for formula (V).

In formula (V), T and U preferably represent —N=; R represents a straight or branched alkylene group or a substituted or unsubstituted arylene group; Z represents a hydrogen atom, a substituted or unsubstituted amino group, a quaternary ammonium group or a heterocyclic ring.

Specific examples of the compound represented by formula (I) according to the present invention are shown below, but it should be noted that the compound of the present invention is not to be limited thereto.

(1)

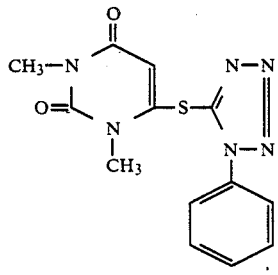

(2)

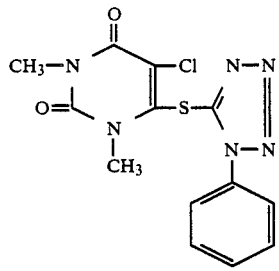

(3)

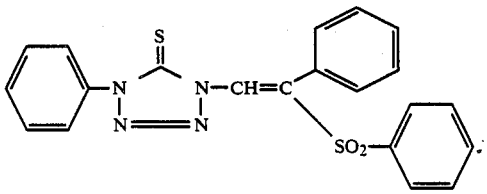

(4)

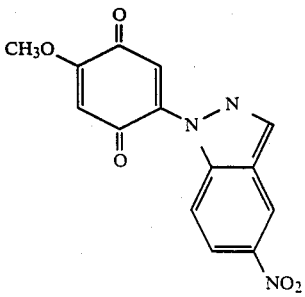

-continued
(5)
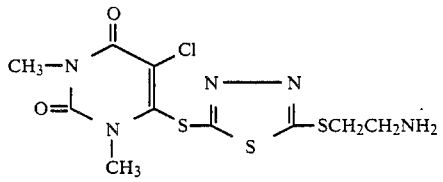
(6)
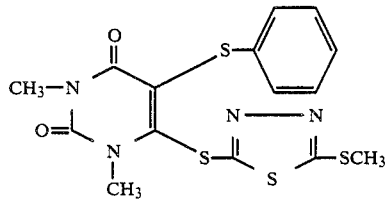
(7)
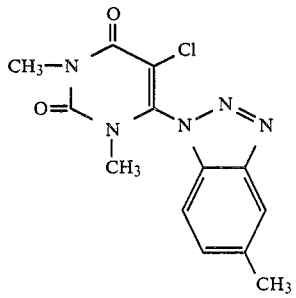
(8)
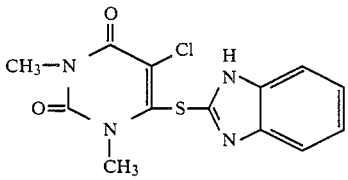
(9)
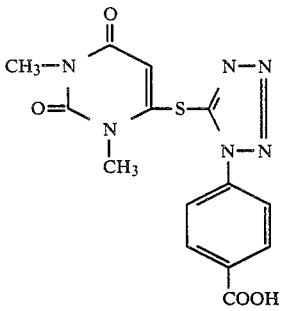
(10)
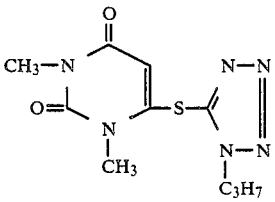
(11)
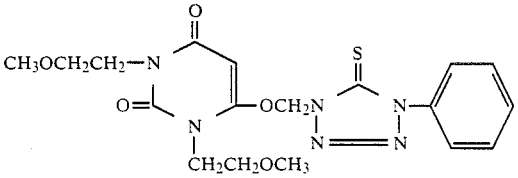
-continued
(12)
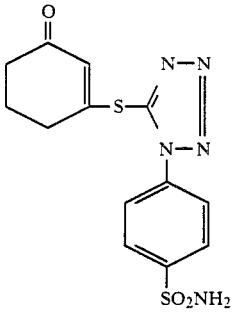
(13)
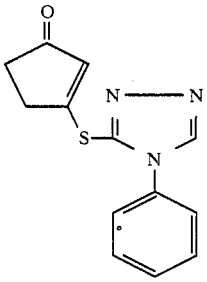
(14)
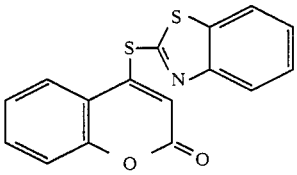
(15)
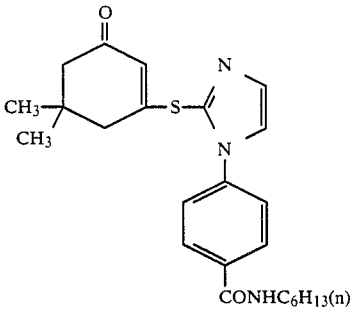
(16)
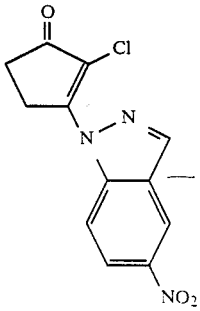

-continued
(17)
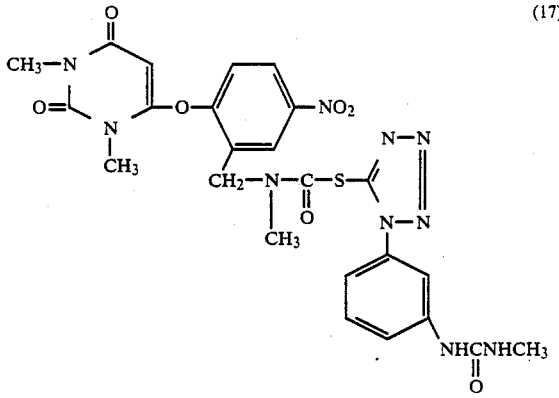
(18)
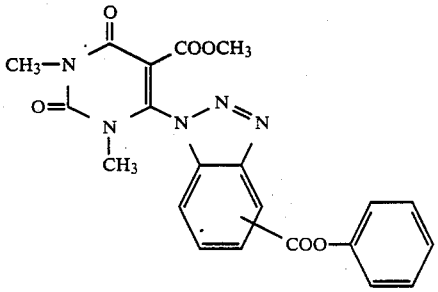
(19)
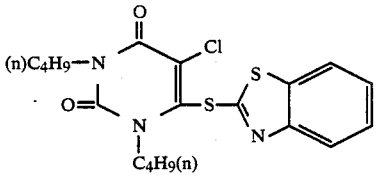
(20)
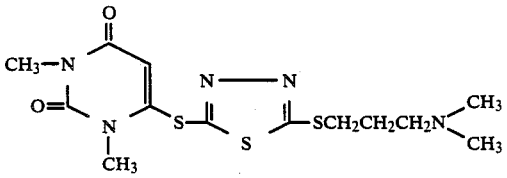
(21)
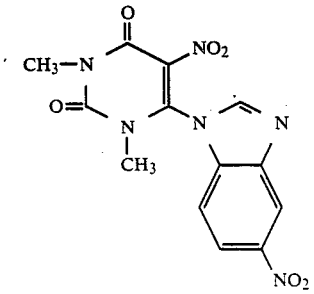
-continued
(22)
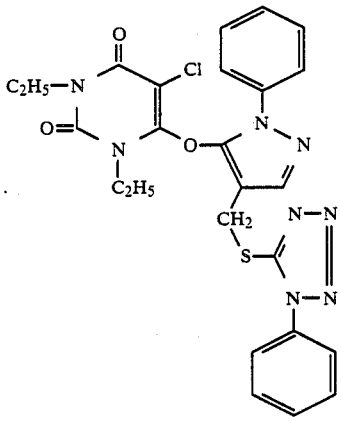
(23)
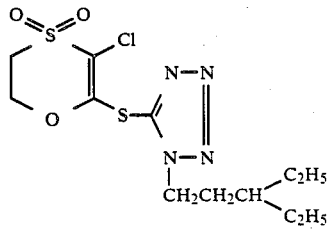
(24)
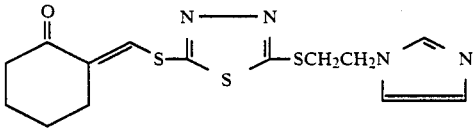
(25)
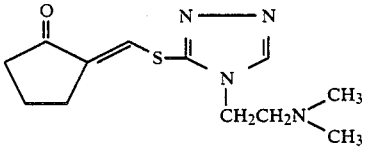
(26)
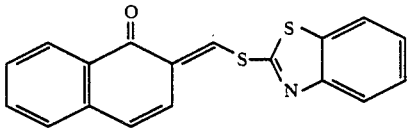
(27)
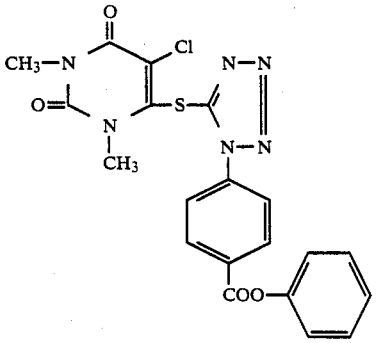
(28)
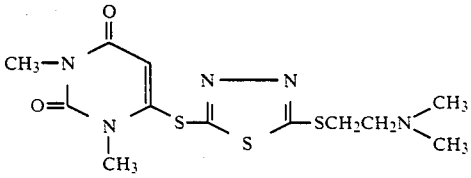

-continued
(29)
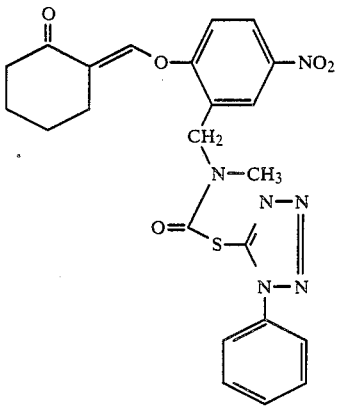
(30)
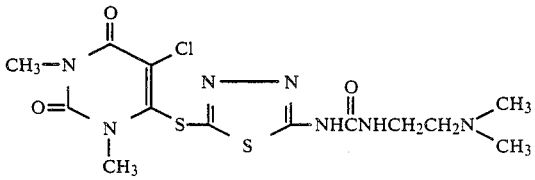
(31)
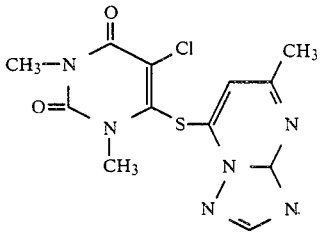
(32)
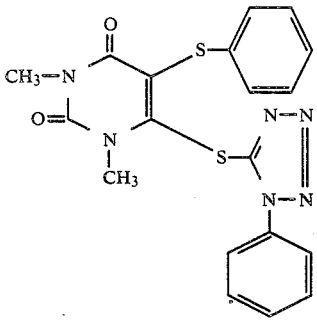
(33)
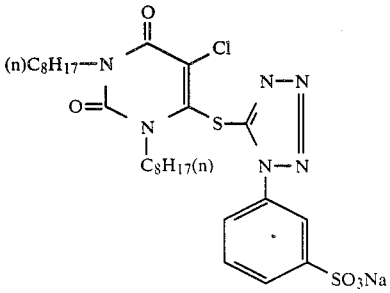
-continued
(34)
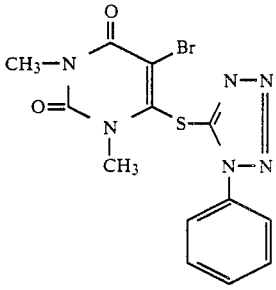
(35)
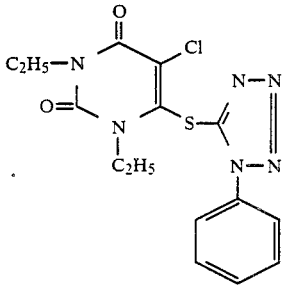
(36)
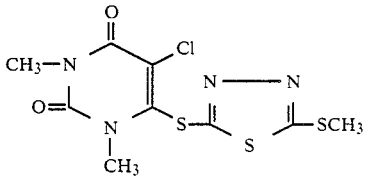
(37)
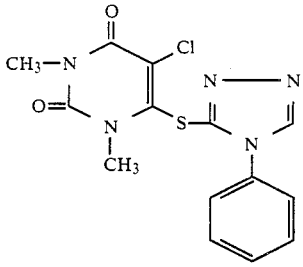
(38)
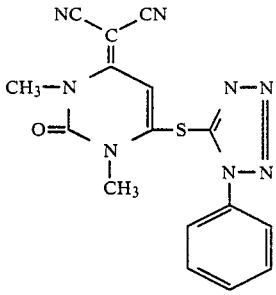
(39)
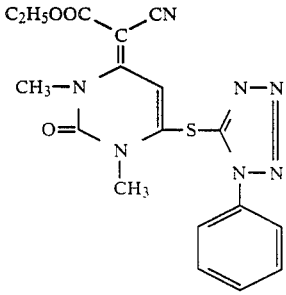

-continued (40)

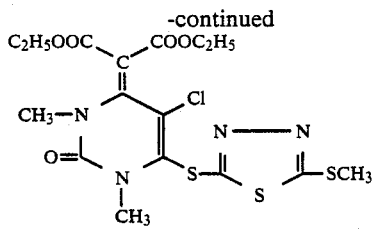

(41)

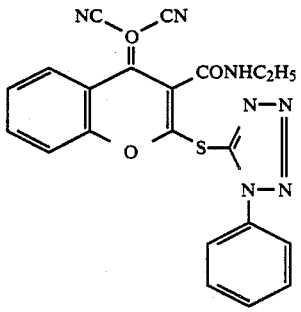

(42)

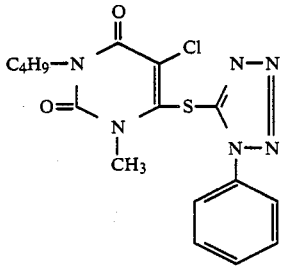

The precursor compound represented by formula (I) can be synthesized by known synthesizing method such as described in Japanese Patent Application (OPI) Nos. 201,057/84, 43,739/86, 95,347/86, etc.

The blocked photographic reagent (i.e., the precursor) according to the present invention may be used in a combination of two or more thereof.

The compound represented by formula (I) according to the present invention, may be added to any of the layers in the silver halide photosensitive material. For example the compound represented by Formula I may be added to the silver halide emulsion layer, a coloring agent layer, a subbing layer, a protective layer, an interlayer, a filter layer, an anti-halation layer, a image receiving layer, a cover sheet layer, a neutralization layer, a neutralization timing layer, a white reflection layer and other auxiliary layers. The compound represented by formula (I) according to the present invention, may be added at any time during the production process, but it is preferably added just before the coating of the layers of the photographic material on the support.

The compound of formula (I) according to the present invention can be used over a wide range of amounts. Specifically, it is preferably used in an amount of from $1\times10^{-6}$ mol/m$^2$ to $1\times10^{-3}$ mol/m$^2$, and particularly from $2\times10^{-6}$ mol/m$^2$ to $2\times10^{-4}$ mol/m$^2$, although this depends on the compound represented by A which is being used.

Since the evaluation of the tone of the support having the white reflection layers is severe, the present invention shows a particularly excellent effect in silver halide photographic material using a support having a white reflection.

Further, the silver halide in the emulsion layer of the present invention is preferably silver halide grains containing little or no iodine.

In the present invention, the support is preferably a water impermeable support. A water impermeable support means those supports through which little or no water is permeated. Such a support can include whitened plastic films comprising a white pigment (such as titanium white) dispersed in a binder (such as gelatin) and coated on a transparent plastic film (such as cellulose triacetate and polyethylene terephthalate), or a paper support laminated on both sides thereof with a hydrophobic polymer (such as polyethylene).

The silver halide in the silver halide photographic material used in the present invention comprises silver halide having a high solubility in the developer solution and a high developing rate, which further contains little or no iodine (i.e., preferably 0.1 mol % or less), Examples of such a silver halide are silver chloride, silver bromochloride or silver bromide. Particularly, an emulsion comprising silver bromochloride or silver bromide, having a silver bromide content of 80 mol % or less and particularly 60 mol % or less is preferred in the present invention. While there is no particular restriction, the average grain size of the silver halide grains is preferably, not larger than 4 μm, more preferably from 1 to 0.2 μm.

The grain size distribution of the silver halide emulsion may be broad or narrow. The emulsion of the latter type is known as so-called monodispersion emulsion and the dispersion coefficient is 20% or less, preferably 15% or less (the dispersion coefficient means the quotient of the standard deviation divided by the average grain size).

Any known solvent for silver halide may be used for forming the silver halide grains.

As a silver halide emulsion, a so-called primitive emulsion which is not chemically sensitized may also be used, but the emulsion is usually chemically sensitized. For the chemical sensitization, the methods described in *P. Glafkides, Chimie et Phyaique Photographique*, Paul Montel Co., (1967), V. L. Zelikman et at, *Making and Coating Photographic Emulsion*, The Focal Press, (1964), or in H. Freser, *Die Grundlagen der Photogrphischen Prozesse mit Silverhalogeniden* (Akademische Verlagsgesellshaft, 1968) may be used. That is, there can be used a sulfur sensitization, using a compound such as thiosulfate, thiourea, thiazole, rhodanine or active gelatine; a reduction sensitization, using a stannous salt, amine, hydrazine, formamidine sulfinic acid or silane compound; a noble metal sensitization, using a gold complex salt, as well as complex salt of metal belonging to the periodic table VIII, such as platinum, iridium and palladium either alone or in combination.

Further, with an aim of increasing the sensitivity, contrast or accelerating the development of the photographic material, a thioether compound, a thiomorpholine, a urethane derivative, a urea derivative, an imidazole derivative, a 3-pyrazolidone, etc., may be incorporated in the photographic material.

In the present invention, the use of gelatin as a a binder or a protective colloid for the photographic emulsion is advantageous, but other hydrophilic colloids may also be used.

For example, proteins such as gelatin derivatives or graft polymers of gelatin and other high polymer; cellulose derivatives, such as hydroxyethyl cellulose and carboxymethyl cellulose; saccharide derivatives, such as starch derivatives; and various synthetic hydrophilic polymer materials, such as homo or copolymers (for example, polyvinyl alcohol, polyvinyl alcohol partial acetal, poly-N-vinyl pyrrolidone, polyacrylic acid or polyacrylic amide) can be used.

As the gelatin, lime-processed gelatin and acid-processed gelatin may be used. Also, gelatin hydrolyzates or enzymatically decomposition products of gelatin may be used.

Generally, in the case of forming silver images on a support having a white reflection layer, although a brightening agent may be used in order to increase the whiteness, this results in a drawback that the photographic sensitivity is reduced along with the added amount of the brightening agent.

However, an unexpected effect has been found that the reduction in the sensitivity due to the brightening agent can be reduced in the system of using the compound of formula (I) according to the present invention.

The brightening agents used in the present invention are those compounds described in K. Veenkataraman, "*The Chemistry of Synthetic Dyes*", *Vol. V*-8. More specifically, there can be used stilbene compounds, coumarin compounds, biphenyl compounds, benzoxazolyl compounds, naphthalimide compounds, pyrazoline compounds, carbostyryl compounds, etc. The stilbene compounds and coumarin compounds are preferred.

More preferably, the brightening agent used in the present invention can include the compound represented by formula (VI):

(VI)

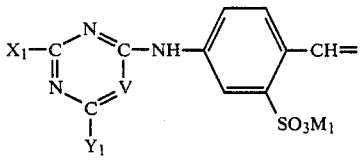

-continued

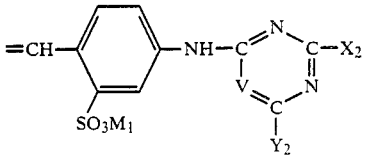

where $X_1$, $X_2$, $Y_1$ and $Y_2$ each represents a hydroxyl group, a halogen atom (for example, a chlorine atom and a bromine atom), a morpholino group, an alkoxy group having generally 1 to 12 carbon atoms and preferably 1 to 6 carbon atoms (for example, a methoxy group, an ethoxy group and a methoxyethoxy group), an aryloxy group having generally 6 to 20 carbon atoms and preferably 6 to 12 carbon atoms (for example, phenoxy group), alkyl group having generally 1 to 12 carbon atoms and preferably 1 to 6 carbon atoms (for example, methyl group and ethyl group), an amino group, an alkylamino group having generally 1 to 12 carbon atoms and preferably 1 to 8 carbon atoms (for example, methylamino group, propylamino group, dimethyl amino group, β-hydroxyethylamino group, di(β-hydroxyethyl)amino group, β-sulfoethylamino group, N-(β-sulfoethyl)-N-methylamino group, N-(β-hydroxyethyl)-N-methylamino group), or arylamino group having generally 6 to 20 carbon atoms and preferably 6 to 12 carbon atoms (for example, an anilino group, o-, m-, p-sulfoanilino group).

$M_1$ represents a hydrogen atom or a cation (for example, a sodium atom, a potassium atom, a ammonium group), and V represents =N— or =CH—.

Among the brightening agents used in the present invention, those water soluble agents may be added directly as an aqueous solution to the photographic material, or may be added in the processing solution and impregnated into the photographic material during the processing step. Water insoluble brightening agents may be added as a solution of a high boiling point organic solvent to the photographic material. Water soluble brightening agent is preferred in view of the step for producing photographic material. Specific examples are shown below but the present invention is not to be limited only to these compounds.

W-1

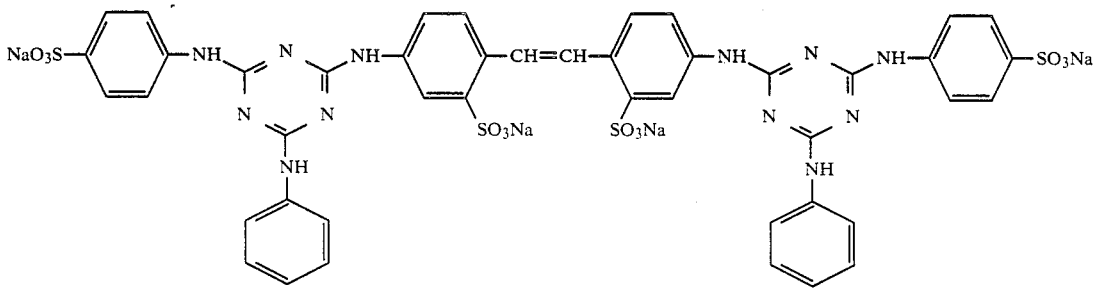

-continued
W-2
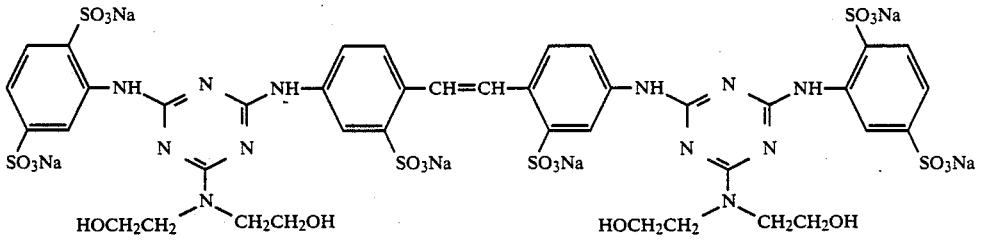
W-3
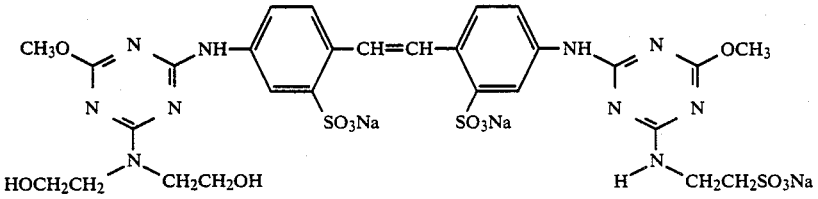
W-4
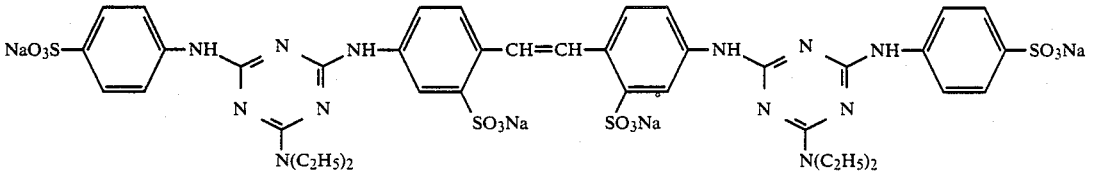
W-5
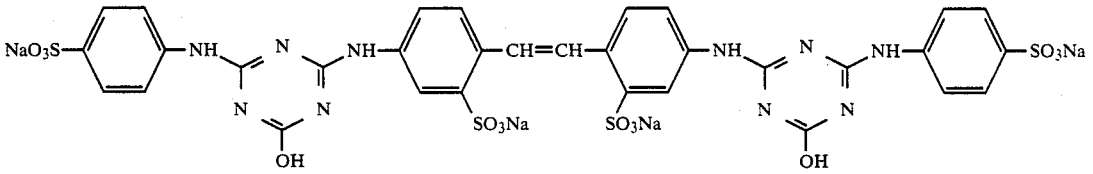
W-6
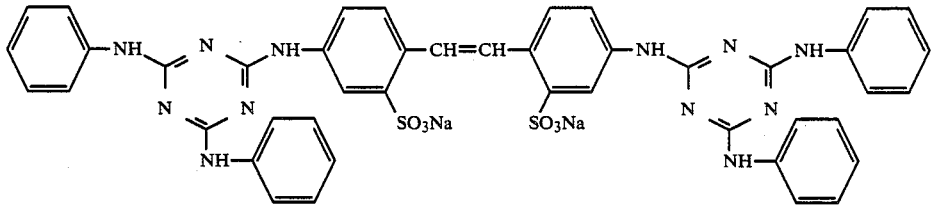
W-7
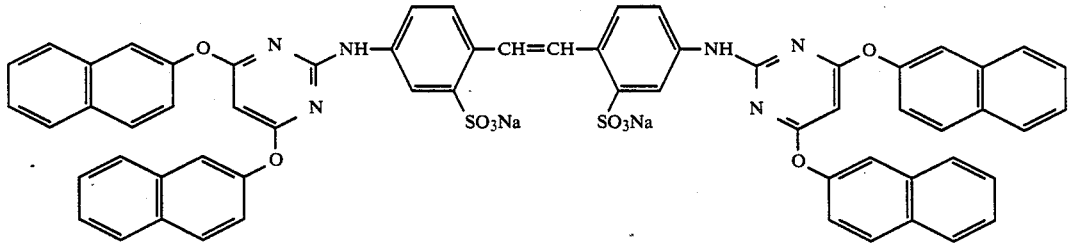
W-8
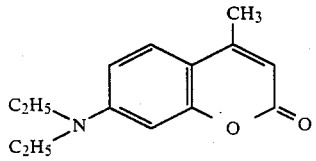

-continued

W-9

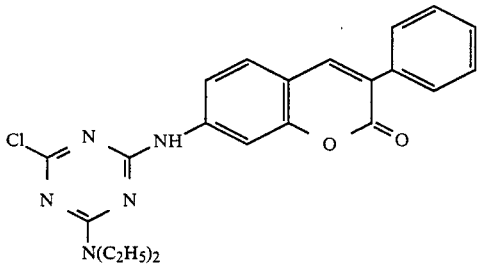

W-10

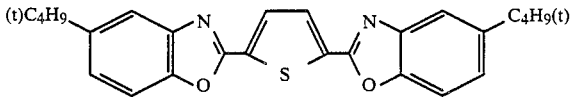

W-11

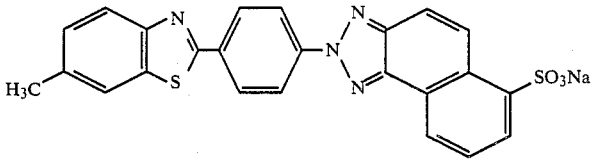

W-12

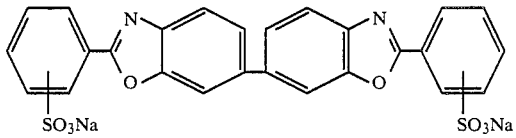

The photographic emulsion layer of the photographic material according to the present invention may further incorporate various known surface active agents for various purposes. For example, the surfactants may be used as coating aids for improvement antistatic properties, for improvement of sliding properties, for improvement of emulsification and dispersion, for improvement of anti-adhesion properties and for improvement of photographic properties (for example, the acceleration of development, increase of contrast, increase of sensitization, etc.).

For instance, there can be used non-ionic surface active agents, for example, saponin, polyoxyethylene type compound, glycidol derivatives (for example, alkenyl succinic acid polyglyceride), fatty acid ester of polyhydric alcohol, alkyl ester of saccharide and urethane or ether of saccharide; anionic surface active agents, such as triterpenoid type saponine, alkylcarboxylic acid salt, alkylbenzene sulfonic acid salt, alkyl sulfate, alkyl phosphate, N-acyl-N-alkyl taurine, sulfosuccinate, sulfoalkyl polyoxyethylene alkylphenyl ether; amphoteric surface active agents such as amino acid, aminoalkyl sulfonic acid, aminoalkyl sulfate or phosphate, alkyl betaine, amine imide, amine oxide; cationic surface active agent such as alkyl amine salt, aliphatic or aromatic quaternary ammonium salt, heterocyclic quaternary ammonium salt such as pyridinium or imidazolium and phosphonium or sulfonium salt containing aliphatic or heterocyclic ring. Fluoro-containing surface active agents are preferably used for the purpose of the antistatic properties.

The photographic material according to the present invention may further incorporate, in its photographic emulsion layer or other hydrophilic colloid layers, water insoluble or sparingly water soluble synthetic polymer dispersions for improving the dimensional stability, etc., of the photographic material.

For instance, there can be used a polymer comprising alkyl(meth)acrylate, glycidyl(meth)acrylate alone or in combination, or the combination thereof with acrylic acid, methacrylic acid, etc., as a monomer ingredient.

The photographic material according to the present invention may further contain in its photographic emulsion layer or other hydrophilic colloid layer, inorganic or organic film hardening agents. For example, there can be used chromium salts, aldehydes, N-methylol compounds, active vinyl compounds (e.g., 1,3,5-triacryloyl-hexahydro-S-triazine, bis(vinylsulfonyl)methyl ether), active halogen compounds (e.g., 2,4-dichloro-6-hydroxy-S-triazine), and mucohalogenic acid, either alone or in combination.

In the photographic material according to the present invention, it is extremely preferred to use known color toners together with the compound of fomula (I) for fine control of the tone. Preferred toners used together with the compound of formula (I) are, for example, mercapto compounds bonded to hetero rings, for example, 1-phenyl-5-mercaptotetrazole, 4-phenyl-3-mercaptotriazole, 2-mercapto-1,3,4-triadiazole.

The amount of the toners used in the present invention is generally from $1\times10^{-6}$ to $1\times10^{-3}$ mol/m$^2$ and preferably from $2\times10^{-6}$ to $2\times10^{-4}$ mol/m$^2$ based on the photographic material.

The photographic emulsion in the present invention may be spectrally sensitized with methine dyes, etc. The dyes usable herein can include, cyanine dyes, merocyanine dyes, complex cyanine dyes, complex merocyanine dyes, phoropolarcyanine dyes, hemicyanine dyes, stylyl dyes and hemioxonole dyes. Particularly useful dyes are merocyanine dyes and complex merocyanine dyes. For the dyes described above, any of nuclei conventionally used for cyanine dyes can be applied as basic heterocyclic nuclei. That is, the applicable nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei and pyridine nuclei; the above mentioned nuclei fused with a cyclic hydrocarbon ring; the above mentioned nuclei fused with an aromatic hydrocarbon ring (that is, indolenine nuclei, benzindolenine nuclei, indole nuclei, benzoxazole nuclei, naphthoxazole nuclei, benzothiazole nuclei, naphthothazole nuclei, benzoselenazole nuclei, benzoimidazole nuclei, quinoline nuclei, etc.). These nuclei may further be substituted on carbon atoms.

As merocyanine dyes or complex merocyanine dyes having a ketomethylene structure, there can be used those 5 to 6 membered heterocyclic nuclei such as pyrazoline-5-one nuclei, thiohydantoin nuclei, 2-thioxazolidine-2,4-dione nuclei, thiazolidine-2,4-dione nuclei, rhodanine nuclei or thiobarbitur acid nuclei.

The photographic material accroding to the present invention may incorporate, in its hydrophilic colloid layer, water soluble dye (oxonole dye, hamioxonole dye, stylyl dye, merocyanine dye, cyanine dye, and azo dye) as a filter dye, or for irradiation prevention or various other purposes.

The silver halide photographic material according to the present invention may also contain known anti-fogging agents or stabilizers. The anti-fogging agents or stabilizers that may be used include mercaptos, benzothizolium salts, nitroindazoles, nitrobenzoimidazoles, chlorobenzoimidazoles, bromobenzoimidazoles, aminotriazoles, benzotriazoles, nitrobenzotriazoles, benzene thiosulfonic acids, benzene sulfinic acids, benzene sulfonic acid amides, azaindenes (for example, triazaindenes, tetrazaindenes, and particularly 4-hydroxy-substituted (1,3,3*a*,7)tetrazaindenes).

For the photographic processing of the photographic material according to the present invention, any of known developing methods for forming silver images can be used. Also, known processing solutions may be used. Though the processing temperature is selected usually from 18° to 50° C., temperatures lower than 18° C. or higher than 50° C. may also be used. The developing solution used for black and white photographic processing can include known developing agents. The developing agents usable herein can include, dihydroxybenzenes (for example, hydroquinone), 3-pyrazolidones (for example, 1-phenyl-3-pyrazolidone), aminophenols (for example, N-methyl-p-aminophenol), 1-phenyl-3-pyrazolines, ascorbic acid, and hetero cyclic compounds comprising 1,2,3,4-tetrahydroquinoline ring and indolene ring condensated with each other as disclosed in U.S. Pat. No. 4,067,872, either alone or in combination. Particularly, the use of dihydroxybenzene together with pyrrolidone and/or aminophenols is preferred. In addition, the developing solution may generally contain known preservatives, alkali agents, pH buffers, anti-fogging agents, etc., and, if desired, dissolution aids, toners, developing accelerators, surface active agents, defoaming agents, hard water softeners, film hardeners, tackifiers, etc. However the photographic material according to the present invention is usually processed with a developing solution containing 0.15 mol/liter or more of sulfite ions as a preservative.

A portion of the main developing agent may be incorporated into the photographic material.

As a fixing solution, usually employed compositions can be used. The fixing agents usable herein may be thiosulfate, thiocyanate, as well as organic sulfur compounds which act as fixing agents. The fixing solution may also contain water soluble aluminum salts as a film hardener.

The present invention is illustrated in more detail with reference to the following examples, although the present invention is not limited thereto.

Unless otherwise specified, all percents, ratio, etc., are by weight.

EXAMPLE 1

(1) Preparation of Light-sensitive Silver Halide Emulsion

An aqueous solution comprising potassium bromide and sodium chloride was added while stirring violently together with an aqueous silver nitrate solution by a double jet method to an aqueous solution of gelatin under acidic conditions (i.e., pH=4), to prepare a cubic mono-dispersed emulsion with 0.4 μm average grain size (50 mol% silver chloride, 14% dispersion coefficient). Then, the emulsion was washed with water with a conventional precipitation method and then applied with sulfur sensitization to obtain a light-sensitive silver bromochloride emulsion A.

(2) Preparation of Coating Specimen

Specimens 1–10 were prepared by disposing each of the layers of the following formulations successively on a paper support laminated on both sides thereof with polyethylene (200 μm thickness) successively from the side of the support.

| | |
|---|---|
| Emulsion Layer | |
| Binder: Gelatin | 4.7 g/m$^2$ |
| Amount of coated silver: | 1.5 g/m$^2$ |
| Sensitizing dye: | 0.3 mg/m$^2$ |

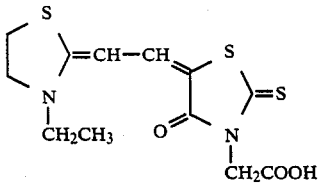

| | |
|---|---|
| Coating aid: Sodium dodecylbenzene sulfonate | 7 mg/m$^2$ |
| Brightening agent: W - 1 (whitex 3B manufactured by Sumitomo Chemical Co., Ltd.) | 0.1 g/m$^2$ |
| Polymer latex: polyethylacrylate | 2 g/m$^2$ |
| Toner: described in Table 1 | |
| Surface protective layer | |
| Binder: Gelatin | 2.0 g/m$^2$ |
| Coating acid: | |
| Sodium dodecyl benzene sulfonate | 80 mg/m$^2$ |
| Colloidal silica (0.05 μm in average size) | 0.3 g/m$^2$ |
| Film hardener: 5-dichloro-6-hydroxy-1,3,5- | 0.08 g/m$^2$ |

-continued

| |
|---|
| triazine sodium salt |

(3) Sensitometry

These specimens were stored at 25° C., 65% RH for 7 days after coating. Each of the specimens was evaluated by the following method. The results of the evaluation is shown in Table 1.

(A) Evaluation for Sensitivity

After exposing each of the specimens through a continuous wedge with tungsten light at a color temperature of 2854° K., 400 lux for one second, they were developed by using a developing solution prepared by diluting a "Fuji Papitol Developing Solution" (manufactured by Fuji Photo Film Co., Ltd.) with water at a developing solution/water ratio of 1/1, stopped and then fixed by "Fuji Fix" (manufactured by Fuji Photo Film Co., Ltd.) for 5 min, washed with water and dried. Then, the photographic sensitivity was evaluated by an exposure amount giving a certain density higher than the fogging density using the same method to each of the specimens (i.e., the certain density: 10.6 optical density).

(B) Evaluation for Fogging

Each of the specimens were developed using "Fuji Papitol Developing Solution" (manufactured by Juji Photo film Co., Ltd.) at 30° C. for 5 min, stopped, fixed, washed with water and dried. Then the fogging density was evaluated.

(C) Evaluation for Tone

Each of the specimens was exposed, developed, stopped, fixed, washed with water and dried in the same manner as in (A) described above, and the tone was evaluated.

(D) Safe-Light Stability

After leaving specimens 1 to 10 for 20 min, at a distance 1 m below the safe-light using a 100 V-20 W tungsten lamp attached with Fuji Safe Light Filter No. 6 (manufactured by Fuji Photo film Co., Ltd.), the specimen was developed, stopped, fixed, water-washed and dried in the same manner as in (A) described above to evaluate the fogging density.

TABLE 1

| Specimen | Compound added (addition amount) | Sensitizing | Fogging | Tone | Blackening density with safe-light |
|---|---|---|---|---|---|
| 1 (Comparative Example) | none | 100 | 0.35 | cold | 0.00 |
| 2 (Comparative Example) | Compound II-1 (4.5 mg/m$^2$) | 55 | 0.00 | warm | 0.04 |
| 3 (Comparative Example) | Compound II-2 (4.5 mg/m$^2$) | 38 | 0.00 | warm | 0.05 |
| 4 (Comparative Example) | Compound II-3 (4.5 mg/m$^2$) | 43 | 0.00 | warm | 0.03 |
| 5 (Comparative Example) | Compound II-4 (4.5 mg/m$^2$) | 76 | 0.02 | warm | 0.03 |
| 6 (Invention) | (2) (9.0 mg/m$^2$) | 105 | 0.00 | warm | 0.00 |
| 7 (Invention) | (6) (9.0 mg/m$^2$) | 101 | 0.00 | warm | 0.00 |
| 8 (Invention) | (13) (9.0 mg/m$^2$) | 108 | 0.00 | warm | 0.00 |
| 9 (Invention) | (28) (9.0 mg/m$^2$) | 120 | 0.02 | warm | 0.00 |
| 10 (Invention) | (35) (9.0 mg/m$^2$) | 104 | 0.00 | warm | 0.00 |

II-1

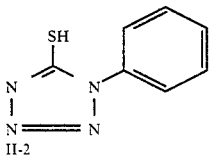

II-2

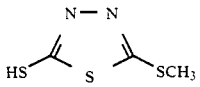

II-3

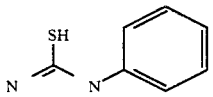

II-4

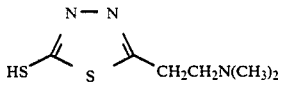

As can be seen from the results of Table 1, if conventional compounds (as added to the specimens 2 to 5) were used in a sufficient amount to provide a warm tone, the sensitivity is remarkably reduced and the blackening due to the safe-light irradiation is worsened. On the other hand, the compounds according to the present invention (as added to the specimens 6 to 10) provide a warm tone without reducing the sensitivity or worsening the blackening caused by safe-light irradiation.

EXAMPLE 2

(1) Preparation of Light-sensitive Silver Halide Emulsion

The procedures were the same manner as in Example 1 described above.

(2) Preparation of Coating Specimen

Specimens 11 to 20 were prepared by disposing each of the layers of the following formulations on a paper support laminated on both sides with polyethylene, successively from the side of the support.

| Emulsion Layer | |
|---|---|
| Binder: Gelatin | 3 g/m$^2$ |
| Amount of coated silver: Emulsion A | 1.5 g/m$^2$ |
| Sensitizing dye: | 0.3 mg/m$^2$ |

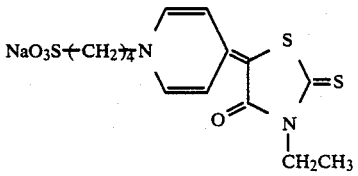

| Toner | 0.4 mg/m$^2$ |
|---|---|

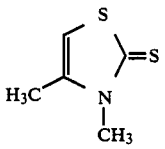

and the compounds described in Table 2.

| | |
|---|---|
| Brightening agent: W-1 (whitex 3B manufactured by Sumitomo Chemical Co., Ltd.) | 0.15 g/m$^2$ |
| Polymer latex: polyethylacrylate | 2 g/m$^2$ |

Surface protective layer

The same as the surface protective layer in Example 1 described above.

(3) Sensitometry

The procedures were the same as those in Example 1, except that using as safe-light for the safe-light test, Fuji Safe Light Filter No. 2A (manufactured by Fuji Photo Film Co., Ltd.). The results of the evaluation are shown in Table 2.

TABLE 2

| Specimen | Compound added (addition amount) | Sensitivity | Fogging | Tone | Blackering density with safe-light |
|---|---|---|---|---|---|
| 11 (Comparative Example) | none | 100 | 0.35 | cold | 0.00 |
| 12 (Comparative Example) | Compound II-1 (4.5 mg/m$^2$) | 70 | 0.00 | warm | 0.06 |
| 13 (Comparative Example) | Compound II-2 (4.5 mg/m$^2$) | 55 | 0.00 | warm | 0.05 |
| 14 (Comparative Example) | Compound II-3 (4.5 mg/m$^2$) | 65 | 0.00 | warm | 0.04 |
| 15 (Comparative Example) | Compound II-4 (4.5 mg/m$^2$) | 80 | 0.02 | warm | 0.05 |
| 16 (Invention) | (2) (9.0 mg/m$^2$) | 105 | 0.00 | warm | 0.00 |
| 17 (Invention) | (6) (9.0 mg/m$^2$) | 101 | 0.00 | warm | 0.00 |
| 18 (Invention) | (15) (9.0 mg/m$^2$) | 105 | 0.00 | warm | 0.00 |
| 19 (Invention) | (32) (9.0 mg/m$^2$) | 116 | 0.02 | warm | 0.00 |
| 20 (Invention) | (34) (9.0 mg/m$^2$) | 104 | 0.00 | warm | 0.00 |

As can be seen from the results of Table 2, the compounds according to the present invention added to specimens 16–20, provide a warm tone without reducing the sensitivity and worsening the image blackening caused by safe-light irradiation.

EXAMPLE 3

(1) Preparation of light-sensitive Silver Halide Emulsion

The procedures were the same manner as those in Example 1 described above.

(2) Preparation of Coating Specimen

Specimens 21 to 29 were prepared by disposing each of the layers of the following formulations on a paper support laminated on both sides thereof with polyethylene successively from the side of the support.

| Emulsion Layer | |
|---|---|
| Binder: Gelatin | 3 g/m$^2$ |
| Amount of coated silver: Emulsion A | 1.5 g/m$^2$ |
| Sensitizing dye: | 0.3 mg/m$^2$ |

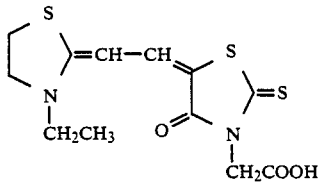

| Toner: | 0.4 mg/m$^2$ |
|---|---|

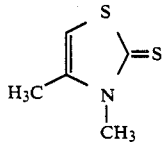

and the compound described in Table 3

| | |
|---|---|
| Brightening agent: W-1 (whitex 3B manufactured by Sumitomo Chemical Co., Ltd.) | 0.15 g/m$^2$ |
| Polymer latex: polyethylacrylate | 2 g/m$^2$ |

Surface protective layer

The same as the surface protection layer as used in Exmaple 1.

(3) Sensitometry

The procedures were the same as those described in Example 1.

The results of the evaluation are shown in Table 3.

TABLE 3

| Specimen | Compound added (addition amount) | Sensitizing | Fogging | Tone |
|---|---|---|---|---|
| 21 (Comparative Example) | none | 100 | 0.65 | cold |
| 22 (Comparative Example) | Compound II-1 (2.3 mg/m$^2$) | 95 | 0.15 | cold |
| 23 (Comparative Example) | Compound II-1 (4.5 mg/m$^2$) | 55 | 0.00 | warm |

TABLE 3-continued

| Specimen | Compound added (addition amount) | Sensitizing | Fogging | Tone |
|---|---|---|---|---|
| 24 (Invention) | (2) (9.0 mg/m$^2$) | 105 | 0.00 | warm |
| 25 (Invention) | (2) (4.5 mg/m$^2$) Compound II-1 (2.3 mg/m$^2$) | 97 | 0.00 | warm |
| 26 (Invention) | (5) (9.0 mg/m$^2$) | 109 | 0.00 | warm |
| 27 (Invention) | (5) (4.5 mg/m$^2$) Compound II-1 (2.3 mg/m$^2$) | 97 | 0.01 | warm |
| 28 (Invention) | (35) (9.0 mg/m$^2$) | 104 | 0.0 | warm |
| 29 (Invention) | (35) (4.5 mg/m$^2$) Compound II-1 (2.3 mg/m$^2$) | 98 | 0.00 | warm |

As can be seen from the results of specimens 21, 22 and 23 set forth in Table 3, the toner represented by compound II-1 can not provide a sufficient toning effect in the addition amount which does not cause sensitivity reduction. On the other hand, a warm tone can be provided by the combined use of compound II-1 together with the compound represented by the formula I according to the present invention without deteriorating the sensitivity, as shown in specimens 25, 27 and 29.

EXAMPLE 4

(1) Preparation of Light-sensitive Silver Halide Emulsion

The procedures were the same as in Example 1 described above.

(2) Preparation of Coating Specimen

| | |
|---|---|
| Binder: Gelatin | 3 g/m$^2$ |
| Amount of coated silver: Emulsion A | 1.5 g/m$^2$ |
| Sensitizing dye: Described in Table 4 | |
| Toner: Described in Table 4 | |
| Brightening agent: W-1 (whitex 3B manufactured by Sumitomo Chemical Co., Ltd.) | 0.15 g/m$^2$ |
| Polymer latex: polyethylacrylate | 2 g/m$^2$ |

Surface protective layer

The same as the surface protective layer as used in Example 1

III-1

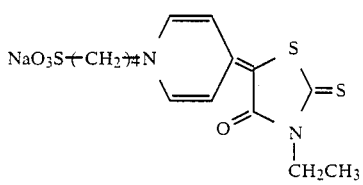

III-2

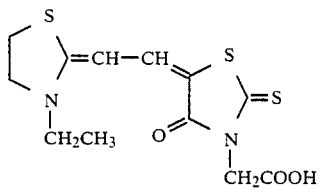

III-3

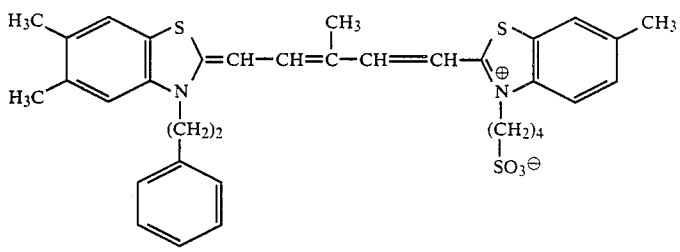

TABLE 4

| Specimen | Compound added (addition amount) | Sensitizing dye (addition amount) | Sensitivity | Fogging | Tone |
|---|---|---|---|---|---|
| 30 (Comparative Example) | II-1 (4.5 mg/m$^2$) | III-1 (0.3 mg/m$^2$) | 55 | 0.00 | warm |
| 31 (Comparative Example) | II-1 (4.5 mg/m$^2$) | III-2 (0.3 mg/m$^2$) | 54 | 0.00 | warm |
| 32 (Comparative Example) | II-1 (4.5 mg/m$^2$) | III-3 (0.3 mg/m$^2$) | 56 | 0.00 | warm |
| 33 (Comparative Example) | II-1 (4.5 mg/m$^2$) | III-2 (0.3 mg/m$^2$) III-3 | 55 | 0.00 | warm |
| 34 (Invention) | (2) (9.0 mg/m$^2$) | III-1 (0.3 mg/m$^2$) | 100 | 0.00 | warm |
| 35 (Invention) | (2) (9.0 mg/m$^2$) | III-2 (0.3 mg/m$^2$) | 130 | 0.00 | warm |
| 36 (Invention) | (2) (9.0 mg/m$^2$) | III-3 (0.3 mg/m$^2$) | 180 | 0.00 | warm |
| 37 (Invention) | (2) (9.0 mg/m$^2$) | III-2 (0.3 mg/m$^2$) | 240 | 0.00 | warm |

TABLE 4-continued

| Specimen | Compound added (addition amount) | Sensitizing dye (addition amount) | Sensitivity | Fogging | Tone |
|---|---|---|---|---|---|
| | | III-3 | | | |

As can be seen from the results of Table 4, if sensitizing dyes are those having light-sensitive regions to blue light, green light and red light, a warm tone can be provided without reducing the sensitivity in specimens 34 to 37 according to the present invention.

EXAMPLE 5

Specimens 38 to 43 were prepared in the same manner as specimen 2 and specimen 6 in Example 1, except for varying the amount of the respective toners. The amounts of toners employed are shown in Table 5 below.

The photographic properties were evaluated by the same methods as employed in Example 1, and the results are shown in Table 5.

TABLE 5

| Specimen | Compound added | Sensitivity |
|---|---|---|
| 38 (Comparative Example) | II-1 (4.3 mg/m$^2$) | 60 |
| 39 (Comparative Example) | II-1 (4.5 mg/m$^2$) | 55 |
| 40 (Comparative Example) | II-1 (4.7 mg/m$^2$) | 50 |
| 41 (Invention) | (35) (8.5 mg/m$^2$) | 105 |
| 42 (Invention) | (35) (9.0 mg/m$^2$) | 105 |
| 43 (Invention) | (35) (9.5 mg/m$^2$) | 105 |

As can be seen from the results of Table 5, though the sensitivity valiation is remarkably dependent on the amount of the compound added in Comparative Example Specimens 38 to 40, the sensitivity valiation depending on the amount of the compound added is small in specimens 41 to 43 according to the present invention. It can be seen from the above results that since the compound according to the present invention shows remarkably small sensitivity valiation as compared with conventional compounds, the photographic material according to the present invention is less affected by the effects of manufacturing steps, and therefore, stable desired effects can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material for obtaining silver images comprising at least one silver halide emulsion layer on a support having a white reflection layer, wherein at least one compound represented by formula (I) is contained in at least one of the constituent layers:

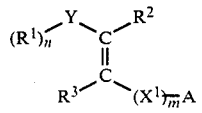

(I)

wherein $X^1$ represents a divalent bonding group bonded by way of a hetero atom to a carbon atom; A represents a group capable of controlling the tone of silver images, which is bonded to $X^1$ by way of the hetero atom of A; $R^1$, $R^2$ and $R^3$ each represents a hydrogen atom or a group which may be substituted, in which $R^1$ and $R^2$, or $R^1$ and $R^3$ may further be bonded together to form a carbocyclic ring or a heterocyclic ring; Y represents:

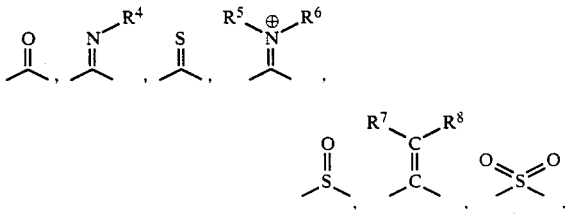

a cyano group or a nitro group, in which $R^4$, $R^5$, $R^6$, $R^7$ and $R^8$ each represent a hydrogen atom or a group which may be substituted; n and m represent 0 or 1, provided that if m is 0, the group represented by A is bonded to a carbon atom by way of the hetero atom of A; and further comprising a brightening agent represented by formula (VI):

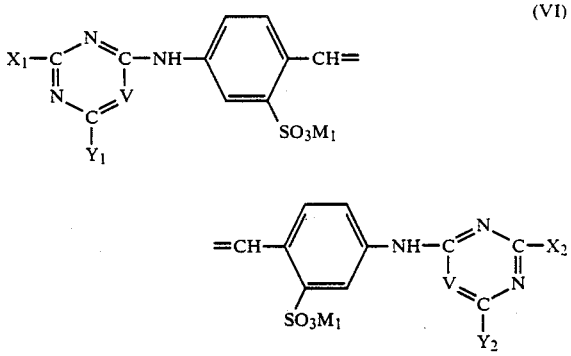

(VI)

wherein $X_1$, $X_2$, $Y_1$ and $Y_2$ each represents a hydroxyl group, a halogen atom, a morpholino group, an alkoxy group, an aryloxy group, an alkyl group, an amino group, an alkylamino group, or an arylamino group; $M_1$ represents a hydrogen atom or a cation; and V represents =N— or =CH—.

2. The silver halide photographic material as in claim 1, wherein A in formula (I) is represented by formulae (IV) or (V):

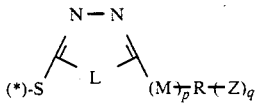

(IV)

-continued

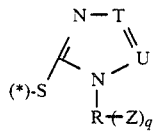

(V)

wherein (*) represents the position bonded to $(X^1)_m$ in the formula (I), L represents an oxygen atom, a sulfur atom or a selenium atom, M represents

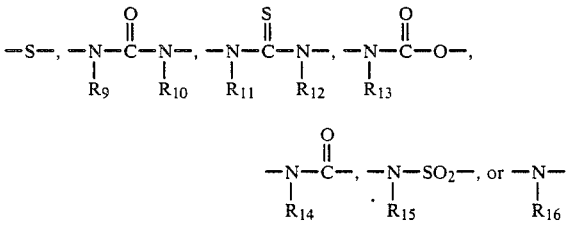

$R_9$, $R_{10}$, $R_{11}$, $R_{12}$, $R_{13}$, $R_{14}$, $R_{15}$ and $R_{16}$ each represent a hydrogen atom, a substituted or unsubstituted alkyl group, a substituted or unsubstituted aryl group, a substituted or unsubstituted alkenyl group, or a substituted or unsubstituted aralkyl group, R represents a hydrogen atom; a straight or branched alkylene group; a straight or branched alkenylene group; a straight or branched aralkylene group; an or arylene group, where the group represented by R may be further substituted, Z represents a hydrogen atom, a hydroxyl group; a cyano group, a substituted or an unsubstituted amino group, including a salt form thereof; a quaternary ammonium group; an alkoxy group; a sulfonyl group; a carbamoyl group; a sulfamoyl group; a carbonamide group; a sulfonamide group; an acyloxy group; a ureido group; an acyl group; a heterocyclic group; an oxy-carbonyl group; or a carbonic acid and salt thereof or sulfonic acid and salt thereof, p represents 0 or 1, q represents 0 if R is a hydrogen atom, and represents 1 if R is not a hydrogen atom, T and U represent

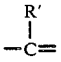

or —N=, and R′ represents a halogen atom, a nitro group, or $—M—_pR—Z)_q$ where M, R, Z, p and q are as defined above.

3. The silver halide photographic material as in claim 1, further comprising at least one toner selected from the group consisting of 1-phenyl-5-mercaptotetrazole, 4-phenyl-3-mercaptotriazole and 2-mercapto-1,3,4-thiazole.

4. A silver halide photographic material as in claim 1, wherein the compound of formula (I) is contained in at least one of said constituent layers in an amount of from $1\times10^{-6}$ mol/m$^2$ to $1\times10^{-3}$ mol/m$^2$.

5. A silver halide photographic material as in claim 1, wherein said silver halide emulsion layer comprises silver halide having a silver bromide content of 80 mol % or less.

6. A silver halide photographic material as in claim 5, wherein said silver halide emulsion layer has an iodide content of 0.1 mol % or less.

7. A silver halide photographic material as in claim 1, wherein said silver halide emulsion layer has a dispersion coefficient of 20% or less.

* * * * *